US011197531B2

(12) United States Patent
Hogan

(10) Patent No.: US 11,197,531 B2
(45) Date of Patent: Dec. 14, 2021

(54) THERMOGRAPHICALLY REPLACEABLE ANTHROPOID SYSTEM

(71) Applicant: Naomi Hogan, Roanoke, VA (US)

(72) Inventor: Naomi Hogan, Roanoke, VA (US)

( * ) Notice: Subject to any disclaimer, the term of this patent is extended or adjusted under 35 U.S.C. 154(b) by 0 days.

(21) Appl. No.: 16/524,857

(22) Filed: Jul. 29, 2019

(65) Prior Publication Data

US 2020/0345124 A1 Nov. 5, 2020

Related U.S. Application Data

(60) Provisional application No. 62/711,091, filed on Jul. 27, 2018.

(51) Int. Cl.

| | |
|---|---|
| ***A45D 44/14*** | (2006.01) |
| ***A45D 20/22*** | (2006.01) |
| *A41G 5/00* | (2006.01) |

(52) U.S. Cl.

CPC ..... *A45D 44/14* (2013.01); *A45D 20/22* (2013.01); *A41G 5/0053* (2013.01)

(58) Field of Classification Search

CPC ..... A45D 44/14
USPC ..... 434/94
See application file for complete search history.

(56) References Cited

U.S. PATENT DOCUMENTS

| | | | | |
|---|---|---|---|---|
| 4,874,345 | A * | 10/1989 | Dirks | A63H 3/44 446/394 |
| 7,186,212 | B1 * | 3/2007 | McMullen | A63H 3/003 600/38 |
| 2002/0011196 | A1 * | 1/2002 | Floyd, II | A47B 23/02 108/157.16 |
| 2013/0230828 | A1 * | 9/2013 | Pang | G09B 19/00 434/94 |
| 2014/0130366 | A1 * | 5/2014 | Blum | A45D 20/00 34/101 |

* cited by examiner

*Primary Examiner* — Kesha Frisby
(74) *Attorney, Agent, or Firm* — Deidre McAuley

(57) ABSTRACT

Provided is a system and a heating method for the system, that includes a stand, a heatable headform disposed on a one end of the stand, and a power supply for receiving power via a power connector from an external power source. The heatable headform receives power from the external power source via the power supply. The system further includes a replaceable human hair covering formed of heat conductive material, to be placed over the heatable headform and heated via the heatable headform for performing hair processing or other chemical processing operations thereon, to simulate that of a human being.

14 Claims, 5 Drawing Sheets

THERMOGRAPHICALLY REPLACEABLE ANTHROPOID SYSTEM

I. CROSS-REFERENCE

This application is a non-provisional application claiming the priority benefit of Provisional Application Ser. No. 62/711,091 filed on Jul. 27, 2018, the contents of which are incorporated herein in its entirety.

II. TECHNICAL FIELD

The present invention relates generally to a hair mannequin and head stand. In particular, the present invention relates to a thermographically replaceable anthropoid system that includes a human hair covering and a heatable headform which are thermographically appropriate to simulate performance of hair color processing and other chemical processing on a human being.

III. BACKGROUND

Hair stylists and technicians typically employ training tools such as a hair mannequin and head stand for holding the hair mannequin thereon, to practice hair color techniques and other chemical processing techniques.

The hair mannequin is typically made of plastic and/or rubber material and includes human hair. The stand is typically a vertical upright stand having a connecting portion at a top end thereof for receiving the hair mannequin. The stand is merely configured to hold the hair mannequin thereon in a fixed position, to enable a user to perform hair processes on the hair mannequin. There are several disadvantages to performing hair coloring processes and other chemical processes on a conventional hair mannequin. For example, the temperature of the hair on the hair mannequin and the mannequin itself is at room temperature (e.g., 73 degrees Fahrenheit). Therefore, the mannequin lacks the necessary heat to initiate the hair coloring or other chemical process at the root or scalp of the mannequin. Further, the hair color or other chemical process has to be processed in one step. On a human being, the chemical processing occurs faster at the first 1.5 inches of the hair near the scalp than the remainder of the hair. Since use of the conventional hair mannequin fails to accurately emulate the hair coloring or other chemical process, over processing can occur when performing these processes on human beings, thereby causing hair damage such as "hot roots" and hair melting resulting in brittle, fragile hair.

IV. SUMMARY OF THE EMBODIMENTS

Embodiments of the present invention provide a system including a human hair covering and heatable headform for receiving the human hair covering thereon, which are thermographically appropriate to simulate performance of hair color processing and other chemical processing on human being According to other embodiments of the present invention, the system is provided. The system includes a stand, a heatable headform disposed on a one end of the stand, and a power supply for receiving power via a power connector from an external power source. The heatable headform receives power from the external power source via the power supply. The system further includes a replaceable human hair covering formed of heat conductive material, to be placed over the heatable headform and configured to be heated via the heatable headform to approximately 98 or 99 degrees Fahrenheit.

In another exemplary embodiment, a method of heating the human hair covering using the above mentioned system is also provided.

The foregoing has broadly outlined some of the aspects and features of various embodiments, which should be construed to be merely illustrative of various potential applications of the disclosure. Other beneficial results can be obtained by applying the disclosed information in a different manner or by combining various aspects of the disclosed embodiments. Accordingly, other aspects and a more comprehensive understanding may be obtained by referring to the detailed description of the exemplary embodiments taken in conjunction with the accompanying drawings, in addition to the scope defined by the claims.

V. DESCRIPTION OF THE DRAWINGS

Figure 1:
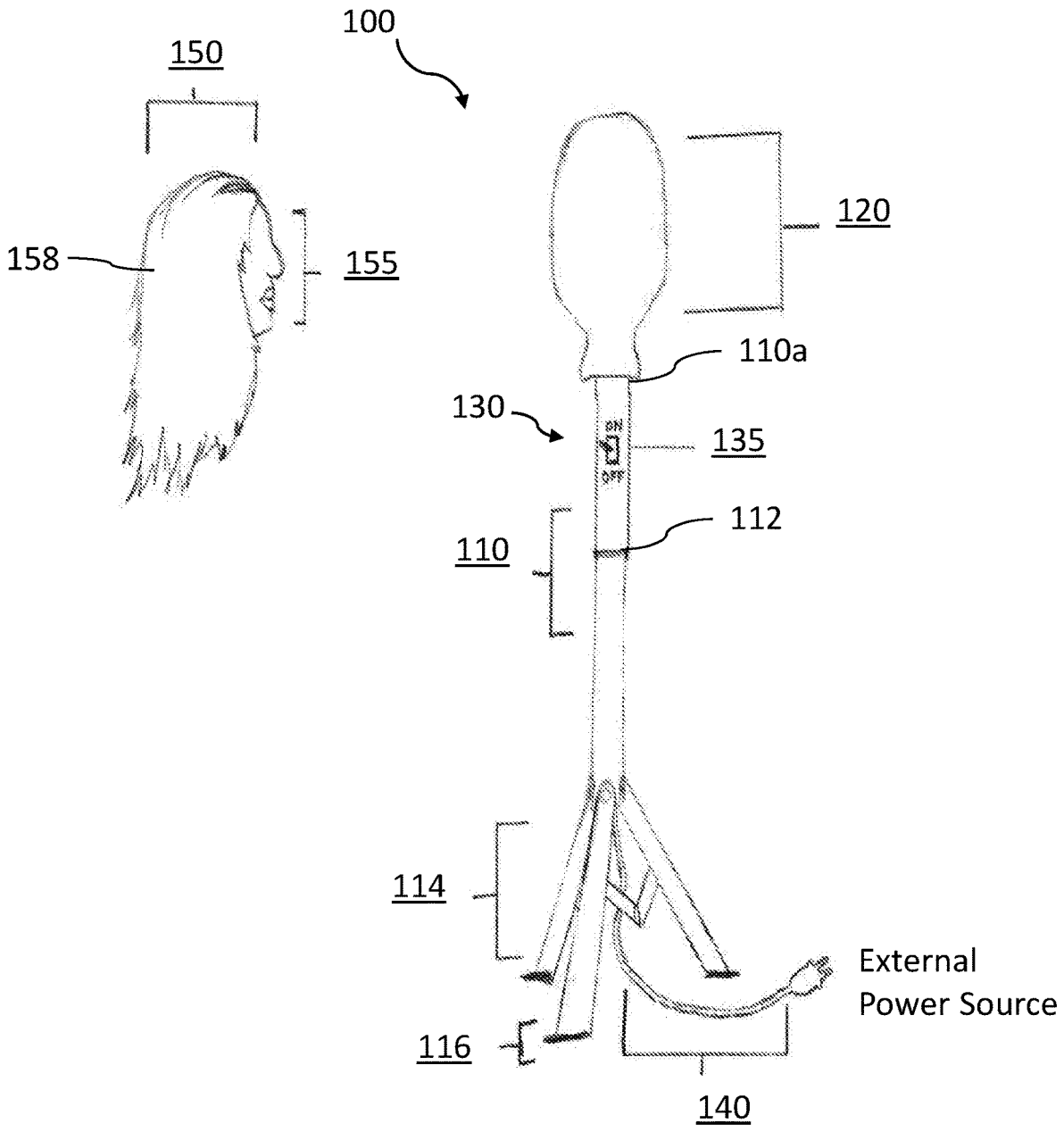
FIG. 1 is a schematic illustrating a system including a heatable headform and stand configuration along with a human hair covering that can be implemented in accordance with one or more embodiments of the present invention.

The drawings are only for purposes of illustrating preferred embodiments and are not to be construed as limiting the disclosure. Given the following enabling description of the drawings, the novel aspects of the present disclosure should become evident to a person of ordinary skill in the art. This detailed description uses numerical and letter designations to refer to features in the drawings. Like or similar designations in the drawings and description have been used to refer to like or similar parts of embodiments of the invention.

VI. DETAILED DESCRIPTION OF THE EMBODIMENTS

As required, detailed embodiments are disclosed herein. It must be understood that the disclosed embodiments are merely exemplary of various and alternative forms. As used herein, the word "exemplary" is used expansively to refer to embodiments that serve as illustrations, specimens, models, or patterns. The figures are not necessarily to scale and some features may be exaggerated or minimized to show details of particular components.

In other instances, well-known components, systems, materials, or methods that are known to those having ordinary skill in the art have not been described in detail in order to avoid obscuring the present disclosure. Therefore, specific structural and functional details disclosed herein are not to be interpreted as limiting, but merely as a basis for the claims and as a representative basis for teaching one skilled in the art.

As noted above, the embodiments provide a system including a human hair covering and heatable headform which are thermographically appropriate for a user (e.g., a hairstylist or technician) to perform hair coloring and other chemical processes on human hair to emulate these processes to be performed on a human being's hair. The heatable headform is capable of being heated to a temperature of approximately 98-99 degrees Fahrenheit similar to that of the human body, in order to accurately perform the chemical processes to prevent unwanted hair damage. Embodiments of the present invention provide effective training of hair stylists and technicians in order to prevent damage to the human hair when these processes are performed on human beings.

Figure 2:
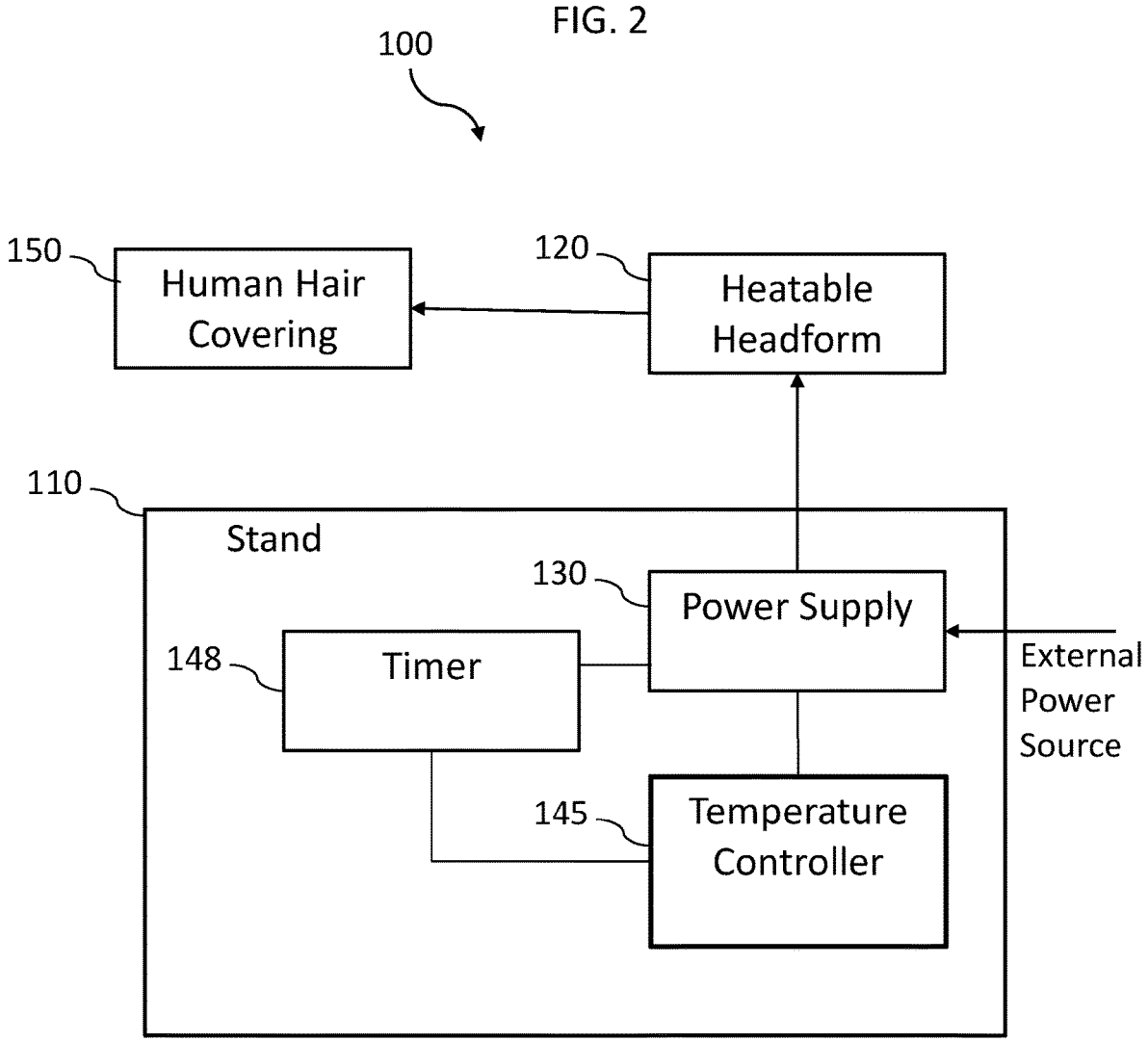
FIG. 2 is a block diagram illustrating the system shown in FIG. 1 according to one or more embodiments of the present invention.

FIGS. 1 and 2 are a schematic and block diagram both illustrating a system 100 according to one or more embodiments of the present invention. As shown in FIG. 1, includes a stand 110, a heatable headform 120 disposed on one end 110*a* of the stand 110, and the stand 110 including a power supply 130 for receiving power via a power supply connector 140 connected to an external power source (not shown).

The stand 110 is formed of a telescoping feature for adjusting the height of the stand 110 to a desirable height of the user, via insertion and/or adjusting of a height of a pin feature 112, to lock the stand 110 in place at the desired height. The stand 110 can therefore be positioned upright on a floor surface or table or other surface as desired. The stand 110 can be formed of metal or other strong material suitable for the purpose herein. The stand 110 further includes tripod legs 114 (e.g., three legs). Each leg 114 is formed of rubber foot grip to prevent slippage.

As further shown in FIG. 1, the heatable headform 120 is formed of a heat conductive material to be heated to approximately 98 or 99 degrees Fahrenheit, upon receiving power via the power supply 130. The temperature range of the heatable headform 120 can be varied, during manufacturing. It is not limited to any particular temperature range. The temperature of the heatable headform 120 can also be varied by the user, as desired when performing a hair processing operation. The heatable headform 120 is shaped of a human head for receiving a human hair covering 150 (e.g., skin) over it to be heated.

Figure 3:
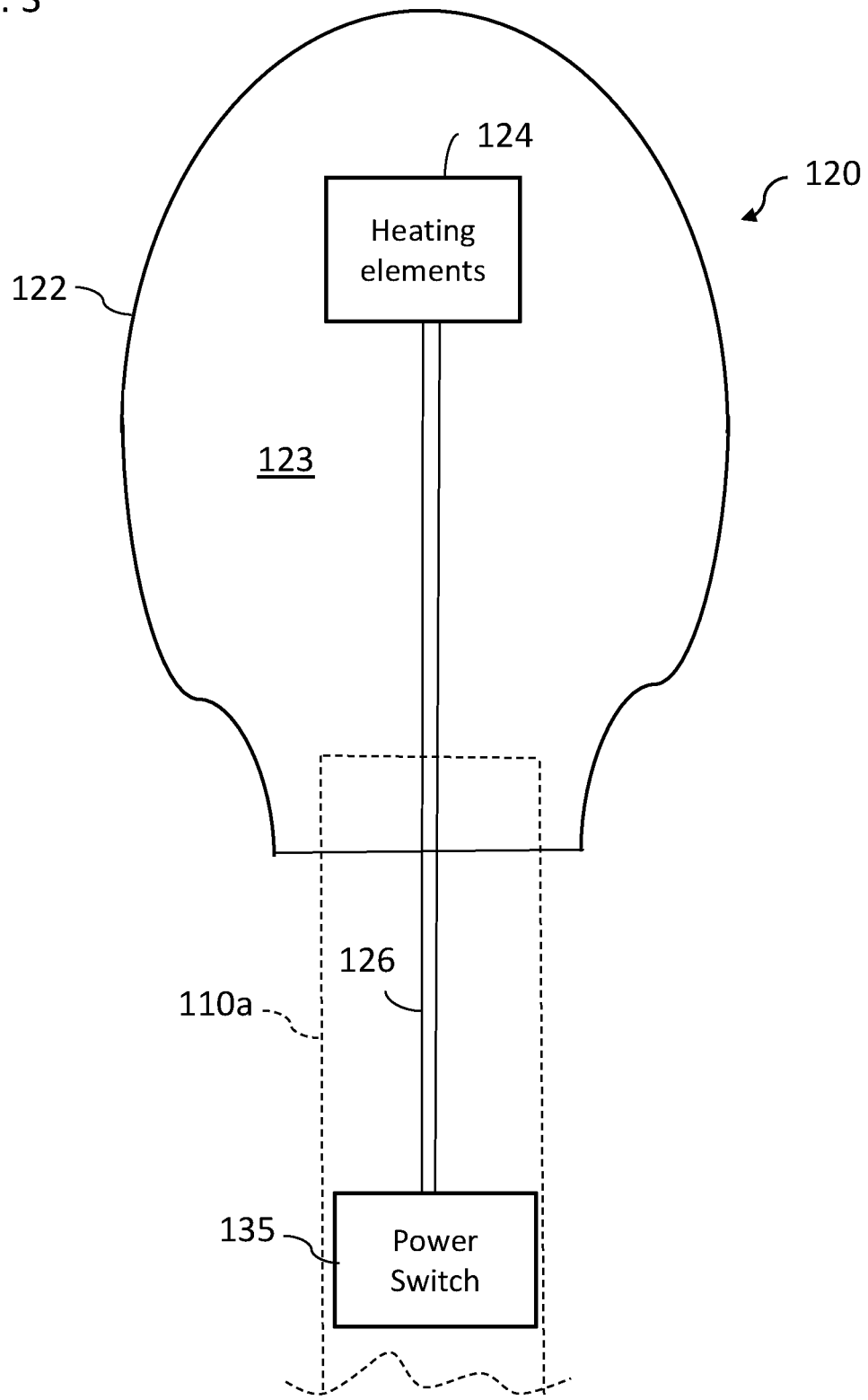
FIG. 3 is a cut-away schematic illustrating an detailed view of the heatable headform of FIG. 1 according to one or more embodiments of the present invention.
Figure 4:
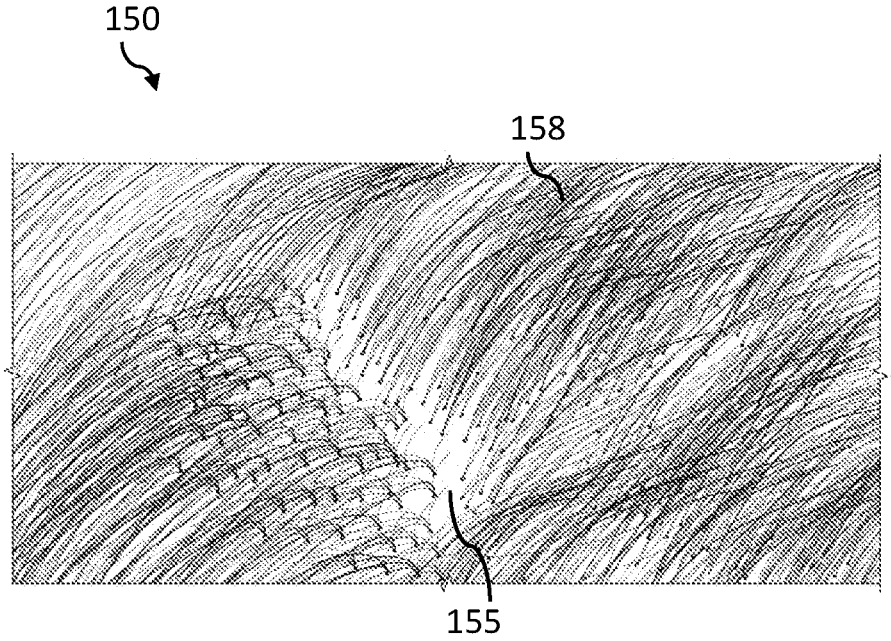
FIG. 4 is a schematic illustrating a detailed view of the human hair covering of FIG. 1 according to one or more embodiments of the present invention.

Additional details regarding the heatable headform 120 are discussed below with reference to FIG. 3. The heatable headform 120 is made of a ceramic material or other heat-conductive material or another material with a ceramic surface and can be a solid surface and hollow or solid on the inside thereof. According to one embodiment, an outer surface 122 of the heatable headform 120 is formed of a non-porous heat-conductive material. The outer surface 122 will heat up from inner circuitry components within an inner area 123 of the heatable headform 120. The inner circuitry components are minimal to create the required heat needed to heat the heatable headform 120. For example, according to one or more embodiments, the inner circuitry components include a heater or one or more heating elements 124 (e.g., heating coils or wires disposed throughout the inner area 123 of the heatable headform 120 similar to that of a heating pad or heat styling tool, and secured by soldered brackets or other heat-resistant small brackets. The heating elements 124 are electrically connected with the power supply switch 135 and power supply 130 via wirings 126 disposed within the stand 110, to receive power supply necessary to generate the heat. The heatable headform 120 can be attached to the end 110*a* of the stand 110 by a metal bracket or some other type of attaching means for securing the end 110*a* of the stand 110 on an inner area 123 of the heatable headform 120. According to one embodiment, the end 110*a* of the stand 110 can be secured within the inner area 123 by a bracket disposed within the base or neck area of the heatable headform 120. The present invention is not limited to any particular heating component or heating process, or securing/attaching means, and any heating component or heating process or securing/attaching means suitable for the purpose set forth herein can be implemented. Additional details regarding the human hair covering 150 will be discussed below with reference to FIG. 4.

Referring back to FIG. 1, the power supply 130 includes an on/off power switch 135 for controlling an on and off state of the system 100.

The power supply connector 140 is formed of a waterproof power cable for fire hazard protection to prevent damage to the system 100. The power supply connector 140 can receive power by being plugged into a power wall socket or from any other suitable power supply source.

As shown in FIG. 2, the stand 110 further includes a temperature controller 145 to control the temperature of the heatable headform 120 to not exceed a predetermined maximum temperature, for example, the maximum temperature can be approximately 99 degrees Fahrenheit. If the actual temperature of the heatable headform 120 has reached the maximum temperature, it will stay heated at the maximum temperature for a predetermined period of time (e.g., 30-45 minutes) and then automatically shutoff via an automatic shutoff feature of the stand 110. The stand 110 can further include a timer 148 for setting a predetermined time for completion of the hair coloring or other chemical process of the human hair covering 150.

The system 100 further includes the replaceable human hair covering 150 formed of heat conducting skin 155 of a flexible, heat conductive material and human hair 158 formed thereon, to be placed over the heatable headform 120. Details of the human hair 158 can be seen in FIG. 4. The human hair covering 150 is configured to be heated via the heatable headform 120 to approximately 98 or 99 degrees Fahrenheit. Once the skin 155 (e.g., scalp) and the hair (i.e., roots) 158 of the human hair covering 150 are heated to the predetermined temperature, a user can begin performing a hair coloring or other chemical process on the human hair covering 150 in a similar manner as they would on a human being in order to accurately practice the processes. As mentioned above, the human hair covering 150 is replaceable therefore, multiple human hair coverings 150 can be employed on the same heatable headform 120. The human hair covering 150 can include a face and neck portion. Further, the face and neck portion can be formed of a silicone material while the skin 155 (i.e., the scalp) can be formed of leather material having holes therein similar to pores for which the hair 158 (i.e, the roots) can penetrate therethrough similar to a human scalp (See FIG. 4). The human hair covering 150 is flexibly stretched to fit over the headform 120 tightly. The human hair covering 150 including the skin 155 is not limited to being formed of a particular material and can therefore be varied as necessary. Any suitable material for the purpose set forth herein can be used.

Figure 5:
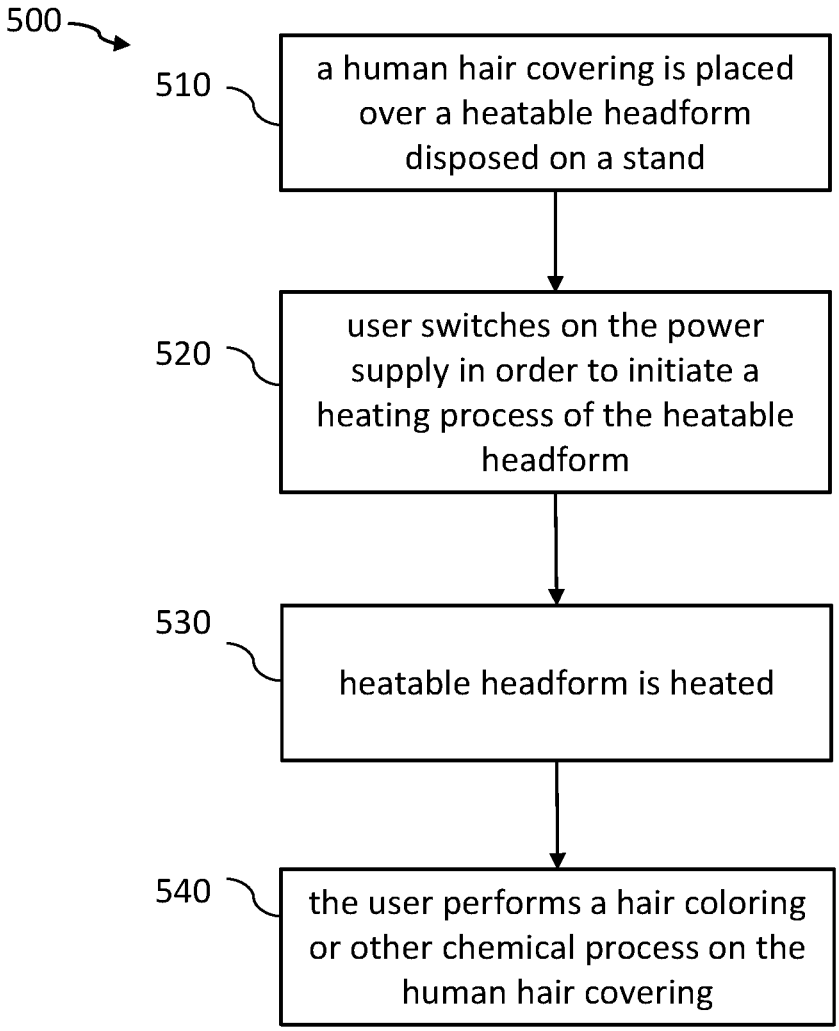
FIG. 5 is a flow diagram illustrating a heating method of the system of FIG. 1 that can be implemented in accordance with one or more embodiments of the present invention.

Additional details regarding a heating method 500 of system 100 will now be discussed with reference to FIG. 5 below. As shown in FIG. 5, the method 500 begins at operation 510 where a human hair covering is placed over a heatable headform disposed on a stand, according to embodiments of the present invention. From operation 510, the process continues to operation 520 where a user switches on the power supply in order to initiate a heating process of the heatable headform. In operation 520, the heatable headform can be heated to approximately 99 degrees Fahrenheit.

From operation 520, the process continues to operation 530 where the heat generated at the heatable headform is used to heat the human hair covering to the approximately 99 degrees Fahrenheit. An audio or visual signal (e.g., a green button) can be included to indicate that the heatable headform has been successfully heated to the maximum temperature (i.e., approximately 99 degrees Fahrenheit). The process then continues to operation 540, where the user performs a hair coloring process or other chemical process on the human hair covering to simulate that of a human being.

Embodiments of the present invention provide a system for performing hair coloring and other chemical processes using a human hair covering formed of a heat conducting skin and a heatable headform in order to emulate performance of the processes on a human being.

This written description uses examples to disclose the invention including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A system comprising:

a stand;

a heatable headform disposed on a one end of the stand;

a power supply configured to supply power to the heatable headform; and a human hair covering formed of flexible, heat conductive material, to be placed over the heatable headform, and configured to be heated via heat generated within the heatable headform, for performing a hair coloring process or other chemical hair process to simulate that of a human being.

2. The system of claim 1, wherein the stand is formed of a telescoping component for adjusting a height of the stand.

3. The system of claim 2, wherein the stand comprises tri-pod legs to facilitate standing in upright position.

4. The system of claim 1, wherein the heatable headform is formed of a heat conductive material.

5. The system of claim 4, wherein the heat conductive material is ceramic material or the heatable headform is formed of another heat conductive material having a ceramic surface.

6. The system of claim 4, wherein the heatable headform is shaped of a human head for receiving the human hair covering over it to be heated.

7. The system of claim 6, wherein the heatable headform comprises a non-porous outer surface.

8. The system of claim 7, wherein the heatable headform further comprising:

one or more heating elements for generating heat, wherein the one or more heating elements being electrically connected with the power supply via electrical wiring; and an interior area for housing the one or more heating elements therein.

9. The system of claim 8, wherein the power supply comprises:

a power switch configured to be electrically connected with the one or more heating elements; and a power supply connector configured to receive power from an external power source to supply power from the power supply to the heatable headform.

10. The system of claim 1, further comprises:

a temperature controller, configured to control a temperature of the heatable headform up to a predetermined maximum temperature; and a timer configured to set a predetermined time for completion of hair processing operation of the human hair covering.

11. The system of claim 10, wherein when an actual temperature of the heatable headform reaches the predetermined maximum temperature, the heated headform remains heated at the predetermined maximum temperature for a predetermined period of time, and then the timer initiates an automatically shutoff process.

12. The system of claim 1, wherein the human hair covering comprises:

a face and neck portion formed of a silicone material; and a skin and scalp portion formed of a leather material having holes therein to allow human hair to penetrate therethrough, wherein the human hair covering is flexibly stretchable to fit tightly over the heatable headform.

13. The system of claim 12, wherein the human hair covering is replaceable.

14. A method comprising:

fitting a human hair covering over a heatable headform disposed on a stand;

switching, via a power switch, a power supply to an on-state, to initiate a heating process of the heatable headform;

heating the human hair covering via heat generated within the heatable headform; and performing a hair processing or other chemical processing operation on the human hair covering to simulate that of a human being.

* * * * *